US006814570B1

(12) United States Patent
Zink et al.

(10) Patent No.: US 6,814,570 B1
(45) Date of Patent: Nov. 9, 2004

(54) VENTURI MIXER AND COMBUSTION ASSEMBLY

(75) Inventors: Darton J. Zink, Tulsa, OK (US); John McDonald, Broken Arrow, OK (US); Rex K. Isaacs, Tulsa, OK (US); Cody L. Little, Coweta, OK (US)

(73) Assignee: Zeeco, Inc., Broken Arrow, OK (US)

( * ) Notice: Subject to any disclaimer, the term of this patent is extended or adjusted under 35 U.S.C. 154(b) by 0 days.

(21) Appl. No.: 10/452,857

(22) Filed: Jun. 2, 2003

(51) Int. Cl.[7] ..... F23D 14/62
(52) U.S. Cl. ..... 431/354; 239/548
(58) Field of Search ..... 431/354, 355, 431/350; 239/548, 22, 42, 425.5

(56) References Cited

U.S. PATENT DOCUMENTS

| | | | | | |
|---|---|---|---|---|---|
| 141,514 | A | * | 8/1873 | Averill | 417/536 |
| 288,445 | A | * | 11/1883 | Karns | 431/354 |
| 423,896 | A | | 3/1890 | Barker | |
| 1,102,751 | A | | 7/1914 | Hicks | |
| 1,157,734 | A | | 10/1915 | Strause et al. | |
| 1,485,371 | A | | 3/1924 | Curran | |
| 1,570,683 | A | | 1/1926 | Kohn | |
| 1,704,875 | A | * | 3/1929 | Vaughn | 431/8 |
| 1,994,547 | A | | 3/1935 | Urquhart | |
| 2,011,283 | A | * | 8/1935 | Huff | 431/116 |
| 2,015,266 | A | | 9/1935 | Gerer | |
| 2,156,405 | A | * | 5/1939 | Smoot | 431/265 |
| 2,217,291 | A | * | 10/1940 | Parrigan | 239/544 |
| 2,369,236 | A | * | 2/1945 | Jaros | 431/179 |
| 2,513,523 | A | * | 7/1950 | Shaffer | 239/419.5 |
| 2,988,139 | A | * | 6/1961 | Coanda | 431/263 |
| 3,236,281 | A | * | 2/1966 | Bain et al. | 75/516 |
| 3,285,241 | A | * | 11/1966 | Bordeaux | 122/14.22 |
| 3,409,382 | A | * | 11/1968 | Voorheis | 431/18 |
| 3,684,189 | A | | 8/1972 | Reed et al. | |
| 3,940,234 | A | * | 2/1976 | Reed et al. | 431/348 |
| 4,629,413 | A | | 12/1986 | Michelson et al. | |
| 5,292,244 | A | | 3/1994 | Xiong | |
| 5,522,722 | A | * | 6/1996 | Diederich | 431/89 |
| 5,704,778 | A | * | 1/1998 | Hsieh | 431/354 |
| 6,027,335 | A | | 2/2000 | Griffioen | |

FOREIGN PATENT DOCUMENTS

| | | | | |
|---|---|---|---|---|
| ES | 2 065 224 | * | 2/1995 | F23D/14/64 |

* cited by examiner

*Primary Examiner*—Carl D. Price
(74) *Attorney, Agent, or Firm*—Fellers, Snider, Blankenship, Bailey & Tippens, P.C.; Dennis D. Brown

(57) ABSTRACT

An improved combustion assembly including a venturi mixer and a combustion tip attached to the discharge end of the venturi divergent section. The improvement comprises eliminating abrupt contractions and sudden expansions of the interior flow passage at the venturi mixer and combustion tip interface.

4 Claims, 5 Drawing Sheets

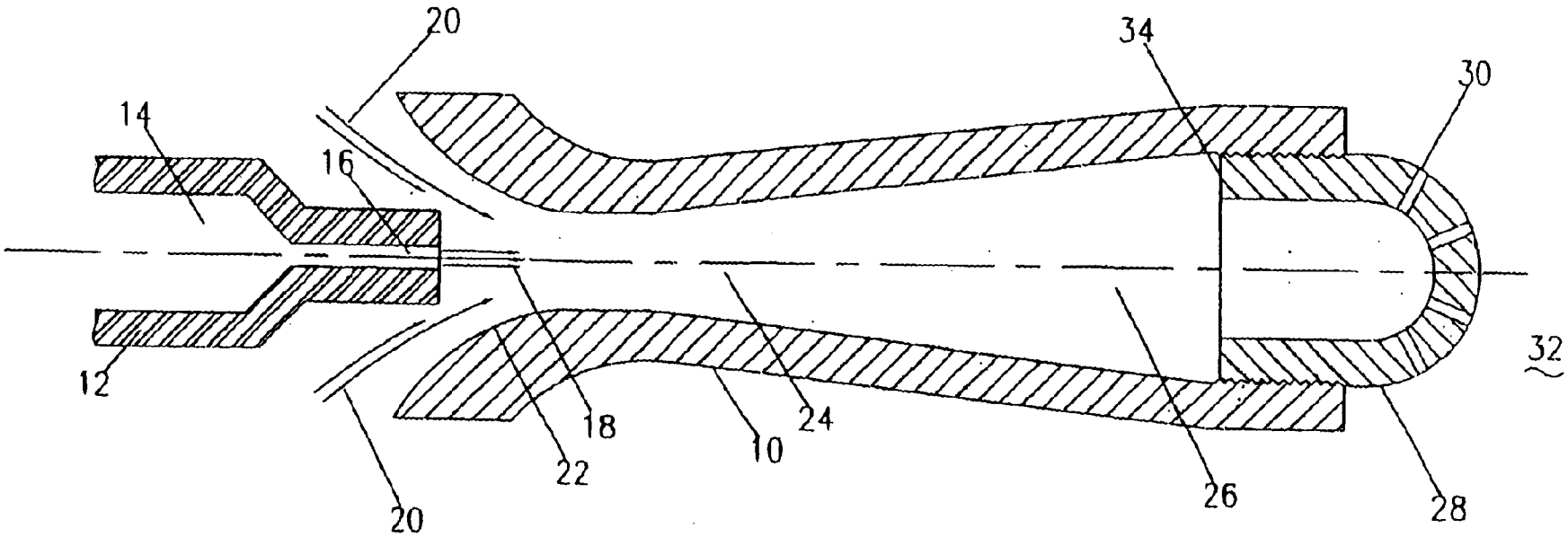
FIG. 1/5
PRIOR ART

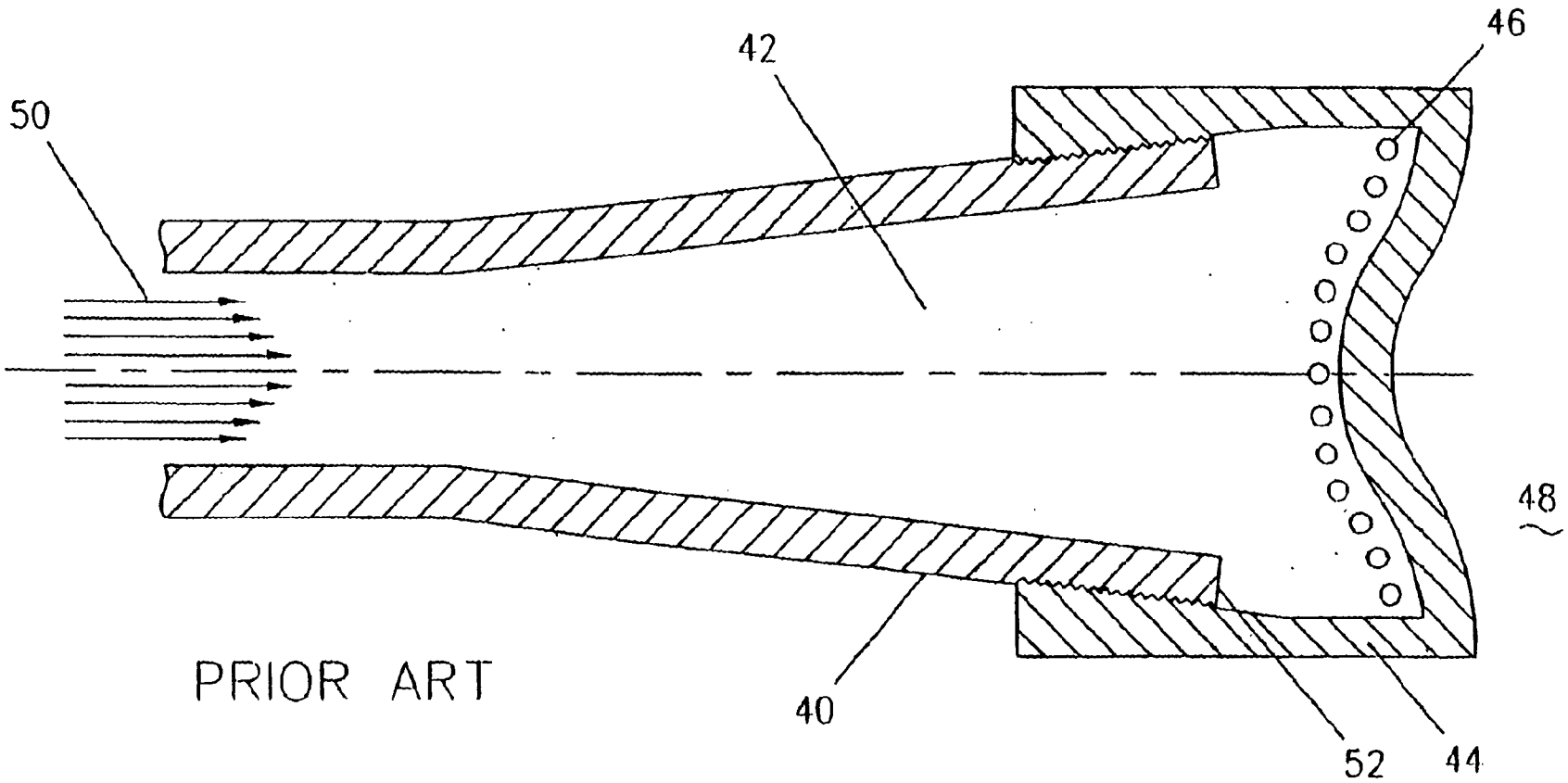
FIG. 2/5
PRIOR ART

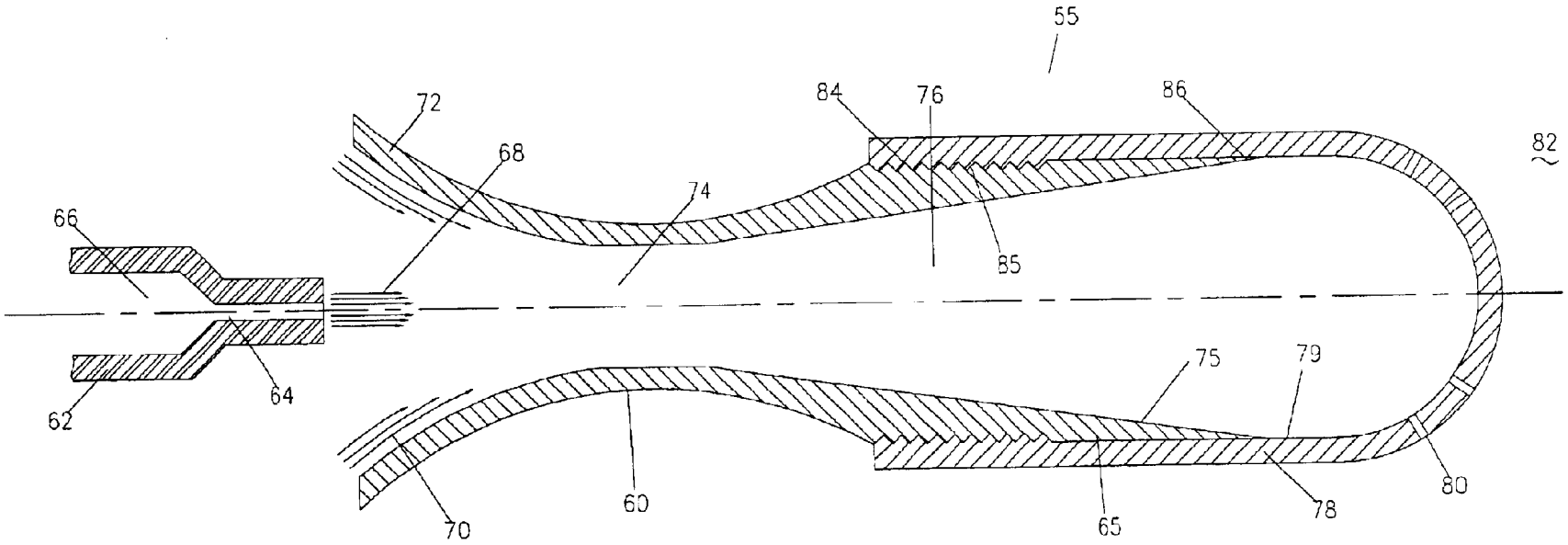
FIG. 3/5

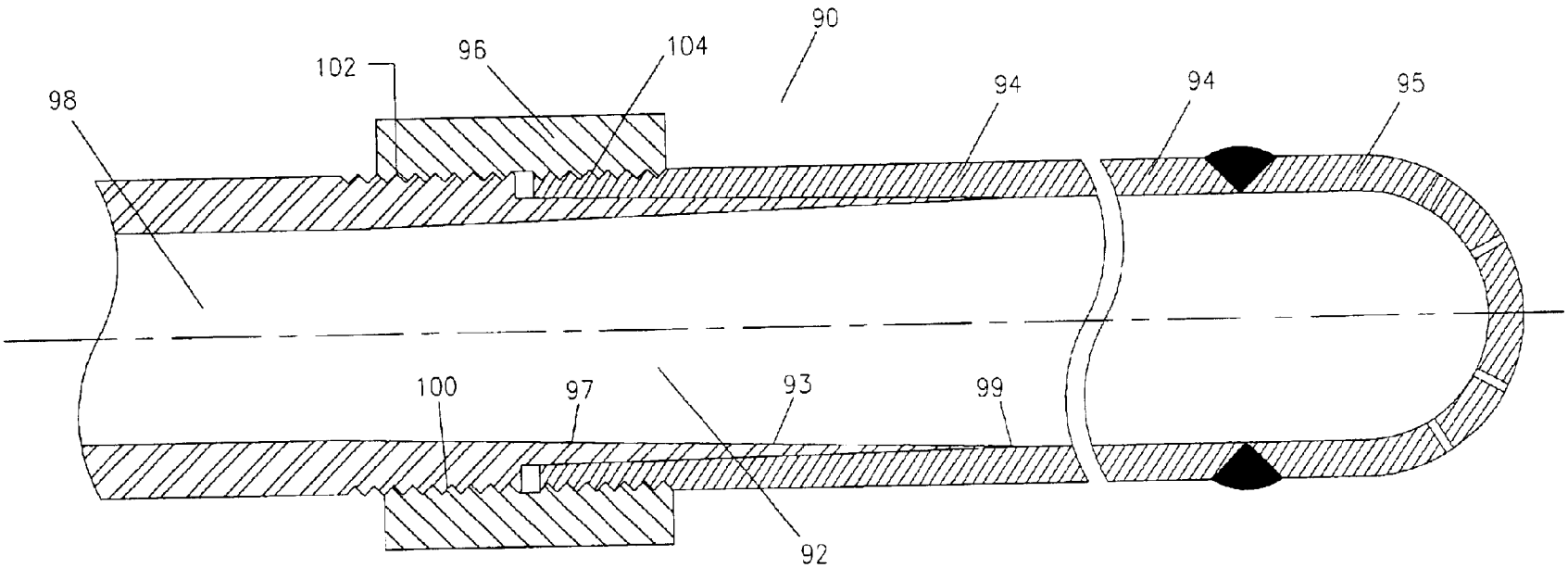
FIG. 4/5

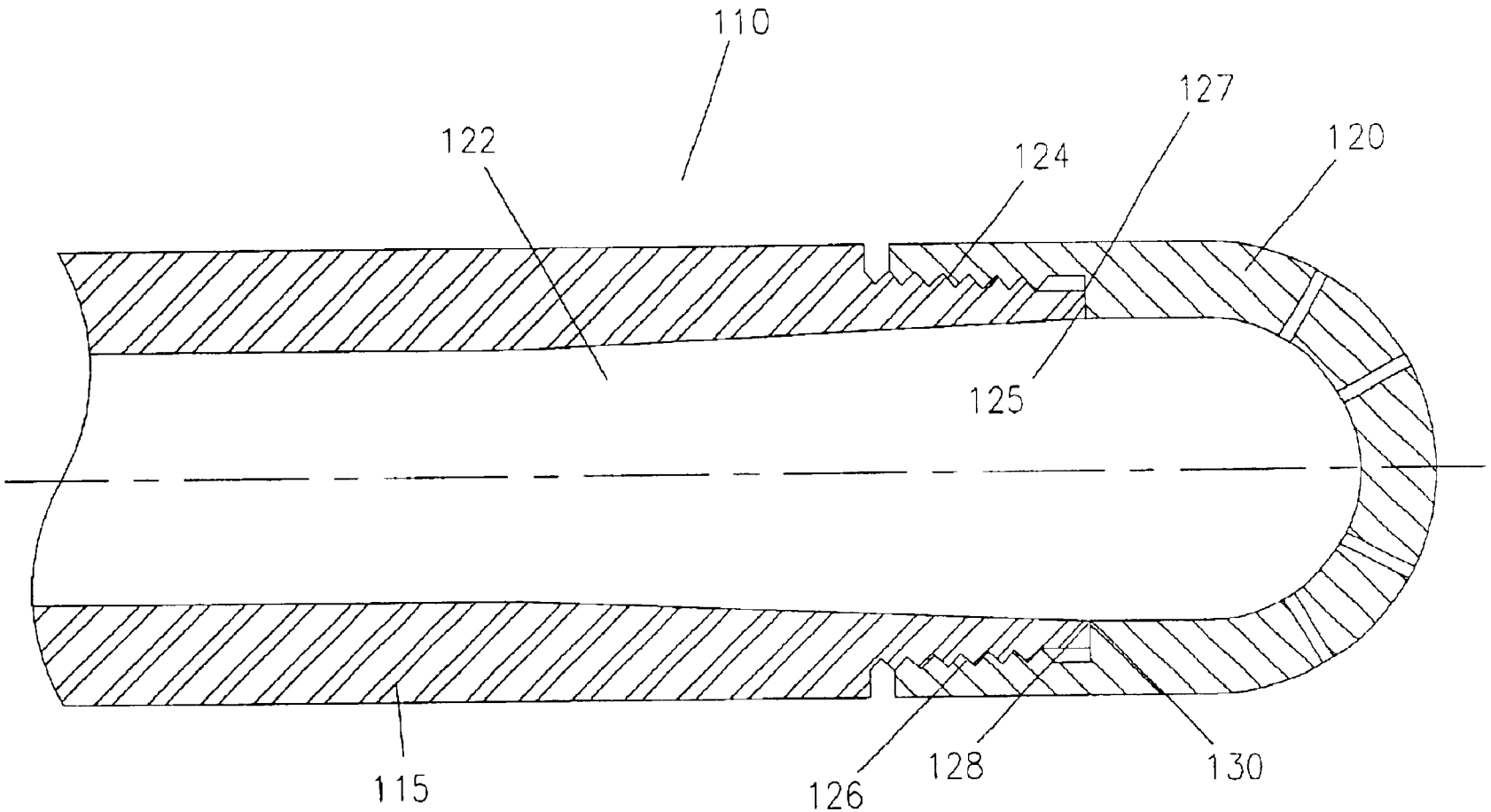
FIG. 5/5

VENTURI MIXER AND COMBUSTION ASSEMBLY

FIELD OF THE INVENTION

The present invention relates to venturi mixers used for delivering fuel and air mixtures to burners and pilots. More particularly, but not by way of limitation, the present invention relates to combustion assemblies comprising venturi mixers having burner tips, pilot tips, or other types of combustion tips attached thereto.

BACKGROUND OF THE INVENTION

Premix burners and pilots have long been employed for producing and burning gaseous fuel and air mixtures in applications ranging from residential furnaces to large process heaters. Premix burners typically use venturi mixers to combine and mix the gaseous fuel and air components and to deliver the resulting fuel/air mixture to a combustion tip (e.g., a burner tip or a pilot tip). As used herein and in the claims, the term "venturi mixer" refers to and includes any venturi, eductor, or similar device wherein the ejection and/or flow of a gaseous fuel is used to draw air into the device and which includes a divergent discharge section from which the resultant mixture of gaseous fuel and air is delivered. Commonly, as fuel under pressure enters the venturi mixer, a low-pressure zone is created that acts to pull air into the mixer. For each cubic foot of fuel ejected into the venturi, between three and eight cubic feet of air may be educted into the venturi depending upon the efficiency of its design.

In a particularly preferred type of venturi mixer, fuel gas under pressure is ejected from an orifice toward the center of a convergent (typically bell-shaped) opening at the rearward (upstream) end of the venturi. A straight section or throat follows (i.e., is positioned forwardly/downstream of) the convergent inlet section. The throat connects, in turn, to a discharge section of the venturi having a divergent interior wall. A combustion tip is then typically welded or threadedly connected to the venturi at the exit end of the divergent discharge section. Fuel gas and air are mixed within the throat and the divergent section of the venturi to provide a uniform combustion mixture which is then delivered through the combustion tip. As used herein and in the claims, the term "combustion tip" refers to a burner tip, a pilot tip, or any other type of combustion tip structure employed for delivering a fuel/air combustion mixture from a venturi mixer into a combustion area preferably downstream of (i.e., outside of) the tip.

Venturi mixers operate in accordance with Bernoulli's Theorem. Because of the high velocity of the fuel gas jet delivered from the fuel gas ejection orifice, a negative pressure is created at the entrance of the venturi. This negative pressure zone continues into the straight section or throat of the venturi and draws air into the throat where the air begins to mix with the fuel gas. In the divergent section of the venturi located downstream of the throat, the gradual enlargement of the flow passage operates to convert the velocity pressure of the fuel gas and air mixture into static pressure. The resultant static pressure provides the motive pressure needed to expel the fuel/air mixture from the flow port(s) of the combustion tip.

Heretofore, premix burners have used methods of attaching the combustion tip to the venturi which have had little regard for minimizing pressure drop at the end of the divergent section. The attachment of the combustion tip often imposes a significant pressure drop due to the existence of a sudden contraction or sudden enlargement at the venturi/combustion tip interface. This pressure drop can significantly and undesirably reduce the degree of static pressure regain attained in the apparatus. Thus, it is an object of the present invention to significantly reduce or eliminate such pressure drop at the exit of the venturi divergent section as it transitions to the burner or pilot tip.

Depicted in FIG. 1 is a prior art combustion assembly comprising: a venturi mixer 10; a combustion tip 20; and a fuel gas supply pipe 12 containing a gaseous fuel 14 under pressure. Gas supply pipe 12 terminates in a fuel metering orifice 16. Gaseous fuel 14 is emitted from orifice 16 in a jet 18. Combustion air 20 is educted into the bell-shaped inlet 22 of mixer 10. The gaseous fuel jet 18 and combustion air 20 are mixed in the venturi throat 24 and in the venturi divergent section 26. As mentioned above, the purpose of the venturi divergent section 26 is to convert the velocity pressure of the fuel/air mixture exiting the throat 24 into static pressure. Burner or pilot tip 28 is secured at the exit end of the venturi divergent section 26 and includes outlet flow ports 30. The fuel/air mixture exits combustion tip ports 30 and is combusted in furnace space 32.

In prior art devices of the type depicted in FIG. 1, the combustion tip 28 is received in the exit end of the venturi divergent section 26 and is typically threadedly connected or welded thereto. In this prior art assembly, an abrupt contraction 34 of the type shown in FIG. 1 is commonly imposed upon fluid stream as it flows into combustion tip 28. The flow obstruction 34 creates a significant pressure drop at the divergent zone exit.

Another typical prior art combustion assembly is shown in FIG. 2. The prior art assembly of FIG. 2 is very similar to the prior art assembly of FIG. 1 except that, in the embodiment of FIG. 2, the discharge end of the divergent section of a venturi mixer 40 is received in a combustion tip 44. The burner tip or pilot tip 44 is commonly attached by threaded means or by welding. The combustion tip 44 includes one or more flow ports 46 through which a gaseous fuel/air mixture 50 exits the tip 44 to be consumed in the furnace space 48. A significant pressure drop occurs in this apparatus because of an abrupt expansion 52 at the interface of the divergent section 42 and the combustion tip 44.

SUMMARY OF THE INVENTION

The present invention provides a venturi mixer and a combustion assembly which alleviate the problems and satisfy the needs discussed above. In the inventive design, the divergent section of the venturi mixer extends into or otherwise interfaces with the interior of the combustion tip in a manner such that abrupt expansion or sudden contraction is either eliminated or at least greatly reduced.

In one aspect, the present invention provides an improvement for a combustion assembly. The combustion assembly includes a venturi mixer and a combustion tip attached to a discharge end section of the venturi mixer. The discharge end section of the venturi mixer has a divergent interior wall. The improvement comprises an extension of the discharge end section which projects the divergent interior wall into the combustion tip. The divergent interior wall preferably terminates at a sharp distal end of the extension which is positioned inside and adjacent to the interior wall of the combustion tip. In this improved assembly, the sharp distal end of the extension preferably touches the interior wall of the combustion tip.

In another aspect, the present invention provides an improvement for a combustion assembly including a venturi mixer and a combustion tip attached to a discharge end section of the venturi mixer wherein the discharge end section has a divergent interior wall and the improvement comprises: the combustion tip having an interior shoulder, the discharge end section of the venturi mixer having a forward end substantially abutting the interior shoulder; the divergent interior wall having an interior diameter at the forward end of the discharge end section of the venturi mixer; and the combustion tip having an interior diameter at the interior shoulder which is substantially equal to the interior diameter of the divergent interior wall at the forward end of the discharge end section of the venturi mixer.

The benefits derived from the present invention will be apparent to those skilled in the art. Because of the reduction in pressure drop at the venturi exit, the device is able to induce more combustion air. Thus, the premix gas burner tip or pilot tip is capable of operating over a wider air to fuel ratio range. Further, the flame propagation speed of the inventive assembly desirably increases as a result of the induction of more combustion air. In addition, with the increase in flame propagation speed comes a desirable increase in flame temperature as well as increased flame stability.

Another benefit of the present invention is the ability of the burner or pilot tip to operate at a higher internal pressure. The port(s) of the combustion tip can therefore be made smaller because of increased discharge pressure. Moreover, a higher internal pressure in the tip desirably provides greater ability to increase the tip exit velocity when needed to match the high flame propagation speeds encountered with certain fuel compositions.

Matching the tip exit port velocity to the flame propagation speed is of particular benefit for burners and pilots used in refinery applications. In an upset condition in a petroleum refinery, the fuel supplied to the burners in the process heaters typically contains a higher percentage of hydrogen. Hydrogen has a very high flame propagation speed. Thus, a low exit velocity at the burner tips or pilot tips can result in flame instability and flashback. However, the burner and pilot assemblies produced in accordance with the present invention can be designed to provide exit velocities exceeding the worst-case flame propagation speeds, thus resulting in greater stability and resistance to flashback.

Further objects, features, and advantages of the present invention will be apparent to those skilled in the art upon examining the accompanying drawings and upon reading the following detailed description of the preferred embodiments.

BRIEF DESCRIPTION OF THE DRAWINGS

FIG. 1 is a sectional view of a prior art venturi mixer/burner tip combination.

FIG. 2 is a sectional view of a second prior art venturi mixer/burner tip combination.

FIG. 3 is a sectional view of an embodiment 55 of the inventive combustion assembly.

FIG. 4 is a sectional view of an alternative embodiment 90 of the inventive combustion assembly.

FIG. 5 is a sectional view of another alternative embodiment 110 of the inventive combustion assembly.

DETAILED DESCRIPTION OF THE PREFERRED EMBODIMENTS

An embodiment 55 of the inventive combustion assembly is depicted in FIG. 3. Combustion assembly 55 comprises a venturi mixer 60 having a burner tip or other combustion tip 78 attached to the discharge end thereof. Assembly 55 further comprises a gas supply pipe 62 which terminates in a fuel metering orifice 64. Gaseous fuel 66, under pressure, is emitted from orifice 64 in a fuel jet stream 68 and causes combustion air 70 to be educted into the bell mouth opening 72 of venturi 60. The fuel jet stream 68 and combustion air 70 mix in venturi throat 74 and in the venturi divergent section 76. Combustion tip 78 is secured on and is in communication with the venturi divergent section 76. The combustion tip 78 includes one or more flow port(s) 80 through which the gaseous fuel/air mixture exits the burner tip 78 to be consumed in the furnace space 82.

The venturi discharge section 76 of inventive assembly 55 is received in the combustion tip 78. As will be understood by those skilled in the art, the combustion tip 78 can be secured on the venturi discharge section 76 by threaded attachment, welding, or any other suitable technique.

Inventive combustion assembly 55 is designed and adapted to overcome the adverse pressure drop effects encountered in the prior art devices. In accordance with the present invention, the venturi discharge section 76 of inventive assembly 55 includes an extension 65 which projects the divergent interior wall 75 of discharge section 76 into the combustion tip 78. The extension 65 and the divergent interior wall 75 preferably terminates at a sharp forward end 86. The sharp end 86 will preferably be circular in shape. To eliminate any sudden expansion in the interior of inventive assembly 55 at the divergent section/combustion tip transition point, the sharp forward end 86 of extension 65 is preferably positioned inside and adjacent to the interior wall 79 of combustion tip 78. Most preferably, the sharp forward end 86 of extension 65 will touch the interior wall 79 of the combustion tip 78.

In the particular embodiment of inventive combustion assembly 55 shown in FIG. 3, the combustion tip 78 is secured on venturi mixer 60 by a threaded connection between internal threads 85 provided in combustion tip 78 and matching exterior threads 84 provided around the venturi divergent section 76. The sharp forward end 86 of venturi extension 65 is spaced forwardly (i.e., downstream of) threads 84 and 85. The sharp forward edge 86 of extension 65 provides a smooth transition between the termination of the divergent section 76 and the combustion tip 78.

An alternative embodiment 90 of the inventive combustion assembly is shown in FIG. 4. The alternative embodiment 90 differs from embodiment 55 in that the combustion tip 95 of inventive assembly 90 is extended a greater distance downstream of the venturi divergent section 92. In applications such as industrial pilots, the venturi mixer is often required to be remotely located from the pilot tip. Thus, in inventive assembly 90, the pilot tip 95 includes an extended rearward section 94.

As with embodiment 55, the venturi divergent section 92 of inventive assembly 90 includes a forward extension 93 which projects the divergent interior wall 97 of the venturi into the rearward section 94 of the combustion tip 95. The venturi extension 93 terminates in a sharp forward edge 99 which most preferably touches the interior wall of the rearward section 94 of combustion tip 95, thus providing a smooth transition from the divergent interior wall 97 of the venturi into the combustion tip 95.

In inventive assembly 90, the venturi is joined to the rearward section 94 of combustion tip 95 by a threaded coupling 96 having interior threads 100. Matching exterior threads 102 and 104 are provided respectively around the venturi divergent section 92 and the rearward section 94 of the combustion tip. The distal end 99 of the venturi extension 93 is preferably spaced forwardly (downstream of) threads 102. As also shown in FIG. 4, an initial portion 106 of the interior of rearward section 94 of combustion tip 95 can also be tapered to accommodate the venturi extension 93.

Another embodiment 110 of the present invention is shown in FIG. 5. Combustion assembly 110 is a close-coupled combination of a venturi 115 and a burner tip 120. Burner tip 120 is attached on the end of venturi divergent section 122. In the particular embodiment of the inventive combustion assembly 110 shown in FIG. 5, exterior threads 124 provided on the venturi divergent section 122 mate with interior threads 126 provided in burner tip 120. However, it will be understood that a welded connection or other suitable attachment could alternatively be used.

In inventive combustion assembly 110, combustion tip 120 preferably includes an interior shoulder 125 positioned forwardly of the combustion tip interior threads 126. When combustion tip 120 is secured on venturi mixer 115, the forward end 127 of the venturi divergent section 122 preferably abuts the combustion tip interior shoulder 125. In addition, the inside diameter 128 of combustion tip 120 at interior shoulder 125 is preferably substantially equal to the inside diameter 130 of the venturi divergent section 122 at its forward end 127. Thus, a smooth transition from the venturi divergent section 122 to the burner tip 120 is provided.

Although the inventive structures shown in FIGS. 3–5 are preferred, it will be understood that, in each of embodiments 55,90, and 110, the attachment between the venturi mixer and the combustion tip could be reversed such that the rearward end of the combustion tip, and/or an extension thereof, having a rearwardly convergent (i.e., forwardly divergent) interior wall is received in the forward (discharge) end of the venturi mixer. In embodiment 110, such reversal would require that the rearward end of the combustion tip abut against an interior shoulder formed within the venturi divergent section.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. In a combustion assembly including a venturi mixer and a combustion tip attached to a discharge end section of said venturi mixer, said discharge end section having a divergent interior wall, the improvement comprising an extension of said discharge end section which projects said divergent interior wall into said combustion tip, said divergent interior wall terminating at a sharp end of said extension which is positioned inside and adjacent to an interior wall of said combustion tip wherein:

said combustion tip is attached to said discharge end section of said venturi mixer by a threaded connection between exterior threads provided around said discharge end section of said venturi mixer and corresponding interior threads provided inside said combustion tip and said sharp end of said extension is spaced forwardly of said interior threads provided inside said combustion tip.

2. The combustion assembly of claim 1 wherein said sharp end of said extension touches said interior wall of said combustion tip.

3. In a combustion assembly including a venturi mixer and a combustion tip attached to a discharge end section of said venturi mixer, said discharge end section having a divergent interior wall, the improvement comprising:

an extension of said discharge end section which projects said divergent interior wall into said combustion tip;

said divergent interior wall terminating at a sharp end of said extension which is positioned inside and adjacent to an interior wall of said combustion tip;

said combustion tip being attached to said discharge end section of said venturi mixer by a coupling; and said coupling is threadedly connected between first exterior threads provided around said discharge end section of said venturi mixer and second exterior threads provided around said combustion tip.

4. The combustion assembly of claim 3 wherein said sharp of said extension is spaced forwardly of said first exterior threads.

* * * * *